US006823790B2

(12) United States Patent
Naniwa

(10) Patent No.: US 6,823,790 B2
(45) Date of Patent: Nov. 30, 2004

(54) LITHOGRAPHIC PRINTING METHOD, INK SUPPLYING APPARATUS, AND PRINTING PRESS

(75) Inventor: Mutsumi Naniwa, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/628,437

(22) Filed: Jul. 29, 2003

(65) Prior Publication Data

US 2004/0020387 A1 Feb. 5, 2004

(30) Foreign Application Priority Data

Jul. 30, 2002 (JP) ..... 2002-221560

(51) Int. Cl.[7] ..... B41L 25/14
(52) U.S. Cl. ..... 101/451; 101/350.4; 101/352.06
(58) Field of Search ..... 101/450.1, 451, 101/452, 350.1, 350.3, 350.4, 352.06, DIG. 34

(56) References Cited

U.S. PATENT DOCUMENTS 4,176,605 A * 12/1979 Yoshida et al. ..... 101/451
4,287,827 A 9/1981 Warner
4,388,864 A 6/1983 Warner
5,044,274 A * 9/1991 Gaunt ..... 101/142
2002/0000171 A1 * 1/2002 Frankenberger ..... 101/483

FOREIGN PATENT DOCUMENTS

JP 55-7453 A 1/1980
JP 58--211484 * 12/1983
JP 2001-270453 A 10/2001

* cited by examiner

*Primary Examiner*—Stephen R. Funk
(74) *Attorney, Agent, or Firm*—Sughrue Mion, PLLC

(57) ABSTRACT

A lithographic printing method of supplying emulsion ink to a lithographic printing plate via a form roller, and disrupting emulsion on the form roller. The degree of the emulsion's disruption before printing has started is different from the degree of disruption after printing has started. The duration of an idling mode can be shortened with the added advantage of reducing the development of waste paper right after the start of printing.

13 Claims, 7 Drawing Sheets

LITHOGRAPHIC PRINTING METHOD, INK SUPPLYING APPARATUS, AND PRINTING PRESS

BACKGROUND OF THE INVENTION

1. Field of the Invention

This invention relates to a lithographic printing method, an ink supplying apparatus for use in the lithographic printing method and a printing press equipped with the ink supplying apparatus.

2. Description of the Related Art

In emulsion-ink based lithographic printing, emulsion ink that attaches itself to a form roller to be supplied to a lithographic printing plate mounted on a plate cylinder in contact with the form roller has the emulsion (specifically, the droplets of its aqueous component) disrupted so that printing is performed with the aqueous component of the emulsion ink having been separated to serve as fountain solution. Compared with the conventional lithographic printing method that separately supplies ink and fountain solution, the emulsion-ink based lithographic printing has the advantage of simplifying the ink supplying apparatus by eliminating the device for supplying fountain solution, with the resulting cost reduction, greater ease in operating the ink supplying apparatus and the like.

Further mention needs to be made of the conventional lithographic printing method which employs separately supplied ink and fountain solution. If printing is to be performed under conditions that are prone to cause scumming as exemplified by the use of a lithographic printing plate having a propensity for scumming, only fountain solution may be supplied to the surface of the lithographic printing plate on the plate cylinder in idling mode which is defined as such a condition that the form roller is out of contact with the plate cylinder before start of printing (i.e. before feeding), and when printing is thereafter started or just before start of printing, the form roller is brought into contact with the surface of the printing plate and the ink is supplied, thereby ensuring that printed matter without scumming is obtained right after starting the printing operation. If printing is to be performed under such conditions that ink receptivity is low as exemplified by the use of a lithographic printing plate of low ink receptivity, only ink may be supplied to the surface of the lithographic printing plate on the plate cylinder in idling mode, and when printing is thereafter started or just before start of printing, fountain solution is supplied, thereby ensuring that printed matter of high ink receptivity is obtained right after starting the printing operation.

However, in the emulsion ink-based lithographic printing method which, as mentioned above, has the aqueous component of the emulsion ink separated as it is on the form roller in contact with the plate cylinder, it is impossible to ensure that either fountain solution or ink is selectively supplied to the surface of the lithographic printing plate on the plate cylinder.

Therefore, when emulsion ink-based lithographic printing is performed by the use of a lithographic printing plate having a propensity for scumming or the like, the ink adhering to the non-image areas is not easy to clean up, causing problems such as the need to prolong the idling mode before start of printing and the development of massive waste paper due to scumming right after starting the printing operation. When it is performed by the use of a lithographic printing plate having low ink receptivity or the like, the ink does not easily attach itself to the image areas, causing problems such as the need to prolong the idling mode and the development of massive waste paper due to poor ink build-up right after starting the printing operation.

Further, the printing press adapted to emulsion inks of the contemplated type, as compared to those which employ conventional non-emulsion inks, has fewer rollers in contact with the printing plate on the plate cylinder, so that the ink will not easily attach itself to the image areas of the printing plate, thereby not only extending the time of idling mode before printing starts but also increasing the chance for the development of massive waste paper.

SUMMARY OF THE INVENTION

An object of the present invention is to provide an emulsion ink-based lithographic printing method by which the duration of idling mode can be shortened while reducing the development of waste paper right after the start of the printing operation even if the printing is performed by the use of a lithographic printing plate prone to cause scumming, one that has low ink receptivity or the like, and to provide an apparatus suitable for use in the method.

The present invention provides the following lithographic printing methods (1)–(3), ink supplying apparatus (4) and printing press (5).

(1) A lithographic printing method of performing lithographic printing by supplying emulsion ink to a lithographic printing plate via a form roller, comprising the steps of:

supplying the emulsion ink to the form roller; and disrupting emulsion on the form roller, with a degree of the emulsion's disruption being changed before and after a start of printing.

(2) The method according to (1), wherein the degree of the emulsion's disruption is changed such that the degree after the start of printing is smaller than that before the start of printing.

(3) The method according to (1), wherein the degree of the emulsion's disruption is changed such that the degree after the start of printing is greater than that before the start of printing.

(4) An ink supplying apparatus for supplying emulsion ink to a lithographic printing plate via a form roller, comprising the form roller from which emulsion ink is supplied, an emulsion disruptor for disrupting emulsion in the emulsion ink on the form roller, and an emulsion disruption controller by which a degree of disruption of the emulsion by the emulsion disruptor is changed before and after a start of printing.

(5) A printing press comprising the ink supplying apparatus according to (4).

As described below, if the present invention is applied to emulsion ink-based lithographic printing, the duration of idling mode can be shortened with the added advantage of reducing the development of waste paper right after the start of printing.

DETAILED DESCRIPTION

The lithographic printing method, ink supplying apparatus and printing press of the present invention are described below in greater detail with reference to the preferred embodiments shown in the accompanying drawings.

Figure 1:
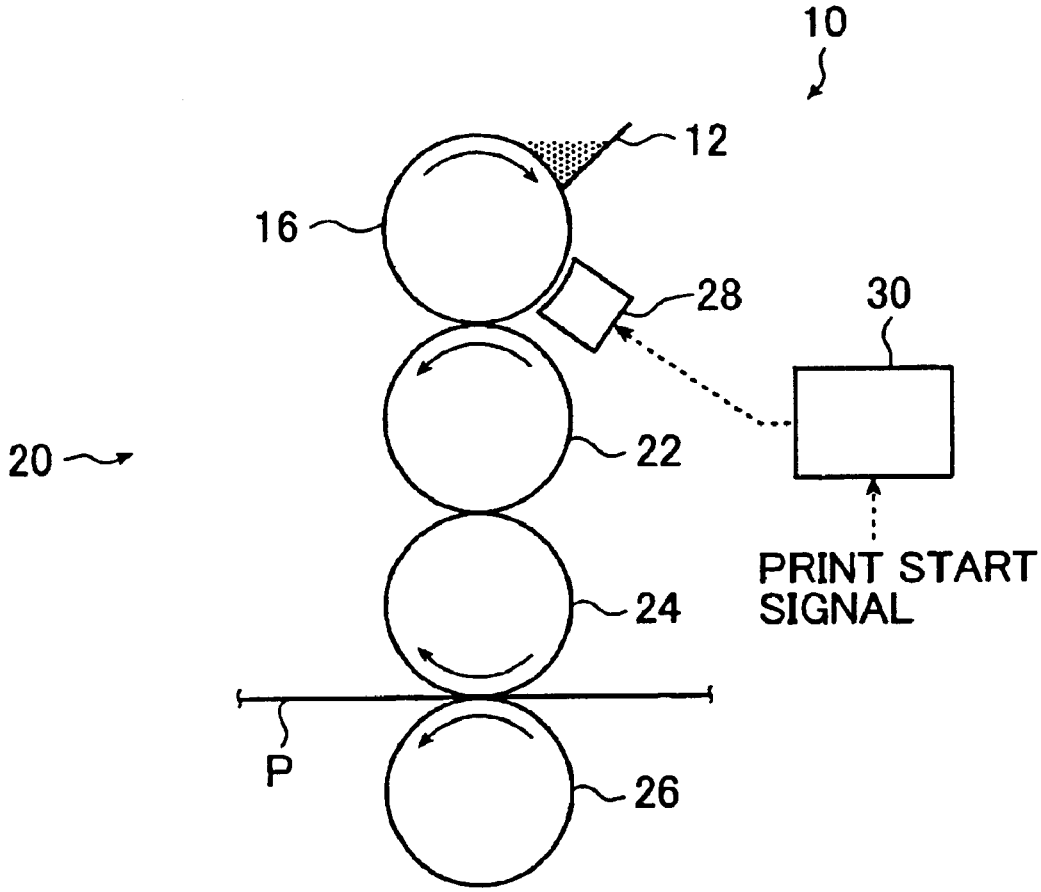
FIG. 1 shows in conceptual form an example of the printing press employing the ink supplying apparatus of the present invention.

FIG. 1 shows in conceptual form an example of the printing press of the present invention comprising the ink supplying apparatus of the present invention for implementing the lithographic printing method of the present invention.

An ink supplying apparatus (inker) indicated by 10 in FIG. 1 consists basically of an ink fountain 12, a form roller 16, an emulsion disruptor 28 and an emulsion disruption controller 30. The ink supplying apparatus 10 is installed in a printing press 20 which performs lithographic printing with emulsion ink. As shown in FIG. 1, the printing press 20 consists basically of the ink supplying apparatus 10, a plate cylinder 22, a blanket cylinder 24, and an impression cylinder 26.

The emulsion ink in the ink fountain 12 indicated by dots in FIG. 1 is transferred from the ink fountain 12 to the form roller 16, on which its emulsion is disrupted by the emulsion disruptor 28 so that part of its aqueous component is separated before the emulsion ink is transferred from the form roller 16 onto a lithographic printing plate (not shown) wrapped around the plate cylinder 22 and thence transferred onto the blanket cylinder 24. The emulsion ink from which part of the aqueous component has been separated is transferred from the blanket cylinder 24 onto a moving substrate P (e.g. printing paper) as it is held between the blanket cylinder 24 and the impression cylinder 26, thereby producing printed matter.

The emulsion ink used in this embodiment is a one-pack ink consisting of a water-in-oil (W/O) type emulsion that is produced by emulsifying an ink component and an aqueous component. The emulsion ink is such that the droplets of the aqueous component are stably dispersed in the ink component in liquid form but when the emulsion is disrupted, part of the aqueous component is separated. As a result, the ink component attaches itself to the oleophilic image areas of the printing plate whereas the aqueous component adheres to the hydrophilic non-image areas of the printing plate, where it serves as fountain solution.

The emulsion ink that can be employed in the present invention is in no way limited and a variety of conventional known types may be used. Specific and preferred examples are the emulsion inks described in JP 49-26844 B (the term "JP XX-XXXXXX B" as used herein means an "examined Japanese patent publication"), JP 49-27124 B, JP 49-27125 B, JP 61-52867 B, JP 53-27803 A (the term "JP XX-XXXXXX A" as used herein means an "unexamined published Japanese patent application"), JP 53-29807 A, JP 53-36307 A, JP 53-36308 A, JP 54-106305 A, JP 54-146110 A, JP 57-212274 A, JP 58-37069 A, JP 58-211484 A, etc.

As already mentioned, the ink supplying apparatus 10 of the present invention consists basically of the ink fountain 12, form roller 16, emulsion disrupter 28 and an emulsion disruption controller 30.

The ink fountain 12 is not limited in any particular way and may adopt conventional known structure. An exemplary case is a blade combined with a roller (which is the form roller 16 in FIG. 1).

In the illustrated case of the ink fountain 12, the gap between the blade tip and the form roller 16 is adjusted to control the thickness of a film of the emulsion ink.

In the present invention, the ink meter is not limited to the illustrated case of the ink fountain 12 and a variety of designs may be employed.

In one example, an anilox roller is combined with a doctor blade in such a way that as the former draws out ink, the latter scrapes the unwanted portion of the ink, thereby supplying a specified quantity of the ink. Alternatively, two rollers are provided either in mutual contact or slightly spaced apart and the pressure of contact between the two rollers or their gap and the rates at which they rotate are controlled to draw out ink in a specified film thickness.

In FIG. 1, the form roller 16 draws a specified film thickness of the emulsion ink out of the ink fountain 12.

The form roller 16 transfers the emulsion ink to the printing plate wrapped around the plate cylinder 22. The form roller 16 is not limited in any particular way and conventional known types may be employed, including not only a roller type but also a belt type.

In order to ensure that no difference in ink density (ghost) will occur on account of uneven ink transfer, the diameter of the form roller 16 is preferably adjusted to be substantially equal to that of the plate cylinder 22.

The emulsion disruptor 28 disrupts the emulsion in the emulsion ink adhering to the form roller 16 such that a part of the aqueous component is separated out. The present invention is characterized in that the degree of disruption of the emulsion in the emulsion ink, or the amount of the aqueous component separated from the emulsion ink, by the emulsion disruptor 28 can be changed before and after the start of printing by the emulsion disruption controller 30.

The structures of the emulsion disruptor 28 and the emulsion disruption controller 30 are not limited in any particular way. In FIG. 1, the emulsion disruptor 28 is physically independent of the emulsion disruption controller 30. But, the two may be designed as an integral unit.

The emulsion disruptor 28 is not limited in any particular way and a variety of conventional known devices may be employed. It may be exemplified by emulsion disruptor by which the emulsion adhering to the form roller 16 is given sufficient shear stress to disrupt the emulsion. Specifically, a preferred example is a roller which, while making contact with the form roller 16, rotates either in the same direction or in opposite direction to a rotation direction of the form roller 16 at the point of contact. This roller slips at the point of contact with the form roller 16, thereby imparting sufficient shear stress to the emulsion ink to disrupt the emulsion.

Another exemplary emulsion disruptor is such that shear stress is applied by contact pressure (or nip pressure) to disrupt the emulsion. Specifically, a preferred example is a roller that contacts the form roller 16 and which, through control of the width of contact (or the width of nip) with the form roller 16, applies contact pressure (or nip pressure), whereby sufficient shear stress is exerted on the emulsion ink to disrupt the emulsion.

As described in JP 53-36308 A, etc., the shear stress applier may be combined with a cooler for cooling the ink. Only the cooling means may be employed as the emulsion disrupter.

In the present invention, it is characterized in that the emulsion is disrupted such that the degree of its disruption is changed before and after the start of printing.

Stated specifically, the degree of disrupting the emulsion by the emulsion disruptor 28 is controlled by the emulsion disruption controller 30. In this case, upon receiving a signal such as a print start signal (feed start signal), the emulsion disruption controller 30 alters the operating state of the emulsion disruptor 28 so as to change the degree of the emulsion's disruption.

Suppose, for example, that the emulsion disruptor 28 is a roller that rotates in contact with the form roller 16. In this case, the emulsion disruption controller 30 alters the rotating speed (and also direction) of the roller, the contact pressure (or nip pressure) between the roller and the form roller 16, etc. may be altered to change the degree of the emulsion's disruption before and after the start of printing. Note that the rotating speed of the roller and the nip pressure between the two rollers may each be adjusted to a single preset value; alternatively, they may be varied stepwise to predetermined settings or varied continuously.

As just described above, according to the present invention, the degree of disrupting the emulsion in the emulsion ink is changed before and after the start of printing. The timing of changing the degree of the emulsion's disruption may be substantially the same as the start of printing (i.e., feeding), provided that it may be several seconds to several tens of seconds before or after the start of printing. The timing of changing the degree of the emulsion's disruption is variable with the rotating speed of the printing press and other factors. Preferably, the degree of the emulsion's disruption is changed within a period ranging from 30 seconds before the start of printing to 10 seconds after the start of printing, more preferably within a period ranging from 20 seconds before the start of printing to 5 seconds after the start of printing, and still more preferably within a period ranging from 10 seconds before the start of printing to 3 seconds after the start of printing. The time taken to change the degree of the emulsion's disruption may be set at any value and it may be changed virtually instantaneously or may be changed over several seconds. The degree of the emulsion's disruption may be changed at multiple levels or continuously.

If a signal is to be sent to the emulsion disruption controller 30 in order to control the emulsion disrupter 28, the operator may recognize the start of feeding visually or otherwise and send the signal to the emulsion disruption controller 30; alternatively, the sending of the signal to the emulsion disruption controller 30 may be electronically associated with the operation of the feeder (not shown) in the printing press 20.

In the present invention, the method of changing the degree of disruption of the emulsion in the emulsion ink is not particularly limited and may be determined as appropriate for the properties of the lithographic printing plate used and other factors.

The following are two preferred examples of the method: (a) changing the degree of the emulsion's disruption such that it is smaller after the start of printing than before printing is started; or (b) changing the degree of the emulsion's disruption such that it is greater after the start of printing than before printing is started.

Figure 2A:
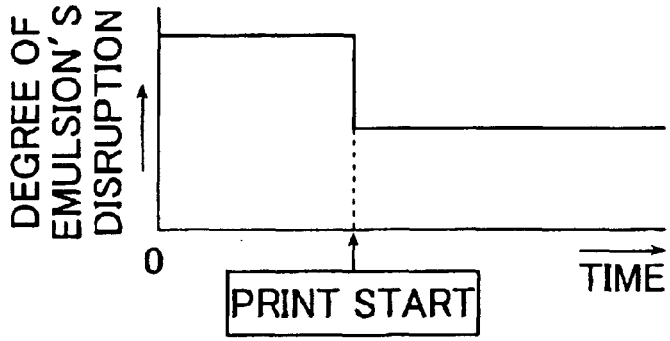
FIGS. 2A–2C are graphs specifically depicting three profiles for changing the degree of disruption of the emulsion in the emulsion ink.
Figure 2B:
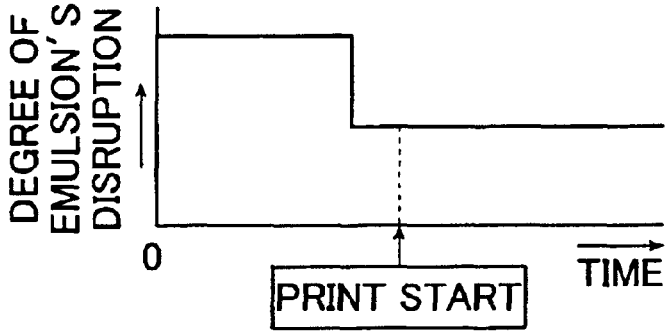
Figure 2C:
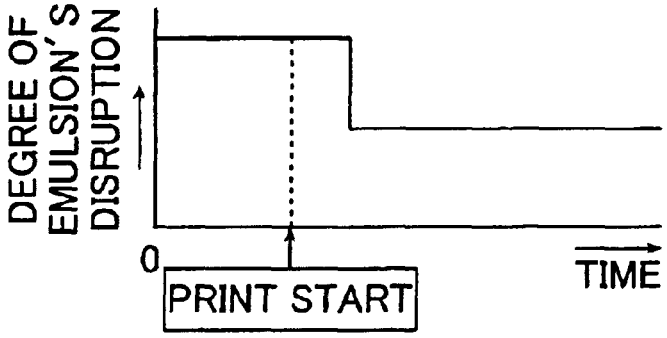
Figure 3A:
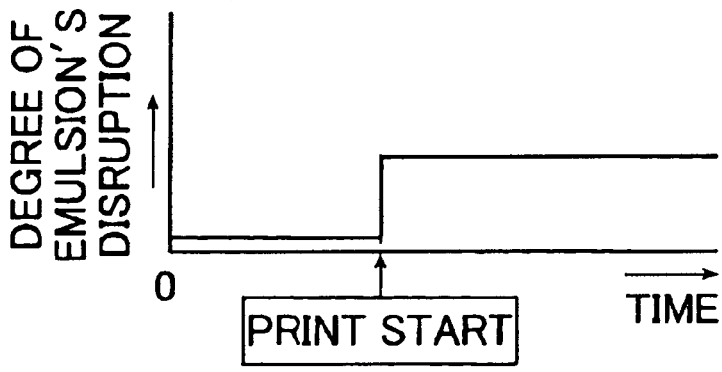
FIGS. 3A–3C are graphs specifically depicting three other profiles for changing the degree of disruption of the emulsion in the emulsion ink.
Figure 3B:
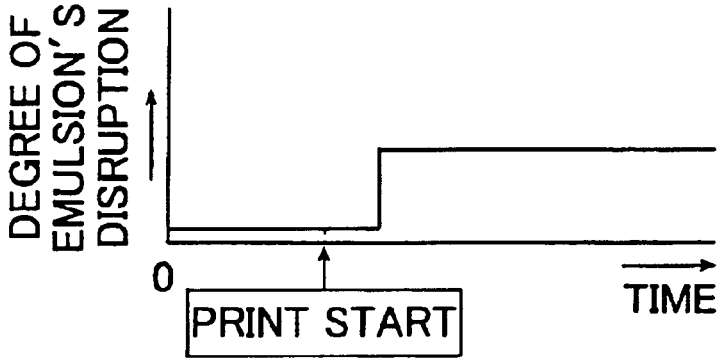
Figure 3C:
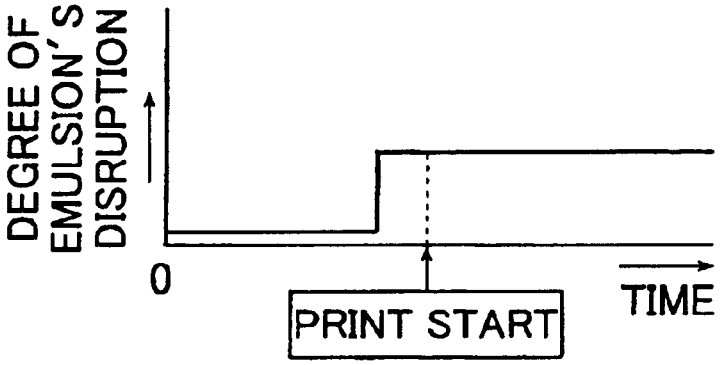

Specific examples of method (a) are depicted in FIGS. 2A, 2B and 2C. FIG. 2A refers to the case of changing the degree of the emulsion's disruption simultaneously with the start of printing; FIG. 2B refers to the case of changing the degree of the emulsion's disruption just before the start of printing; FIG. 2C refers to the case of changing the degree of the emulsion's disruption just after the start of printing. Specific examples of method (b) are depicted in FIGS. 3A, 3B and 3C. FIG. 3A refers to the case of changing the degree of the emulsion's disruption simultaneously with the start of printing; FIG. 3B refers to the case of changing the degree of the emulsion's disruption just after the start of printing; FIG. 3C refers to the case of changing the degree of the emulsion's disruption just before the start of printing.

According to method (a), the degree of the emulsion's disruption before the start of printing is greater than the degree after the start of printing and, hence, more of the aqueous component of the emulsion ink is separated before the start of printing to ensure that a massive amount of the aqueous component is supplied to the printing plate before printing starts. Therefore, according to method (a), even if printing is performed under conditions that are prone to cause scumming in the conventional method, as exemplified by the use of a lithographic printing plate that has a propensity for scumming, scumming is less likely to occur and, hence, not only can the duration of the idling mode before the start of printing be shortened but it is also possible to control the development of waste paper due to scumming right after the start of the printing operation.

According to method (b), the degree of the emulsion's disruption before the start of printing is smaller than the degree after the start of printing and, hence, less of the aqueous component of the emulsion ink is separated before the start of printing to ensure that a massive amount of the ink component is supplied to the printing plate before printing starts. Therefore, according to method (b), even if printing is performed under low ink-receptivity conditions in the conventional method, as exemplified by the use of a lithographic printing plate that has low ink receptivity, satisfactory ink build-up is provided and, hence, not only can the duration of the idling mode before the start of printing be shortened but it is also possible to control the development of waste paper due to poor ink build-up right after the start of the printing operation.

The degree of the emulsion's disruption may be changed at multiple levels or continuously.

For example, method (a) or (b) described above may be performed by changing the degree of the emulsion's disruption at multiple levels or continuously.

Figure 4A:
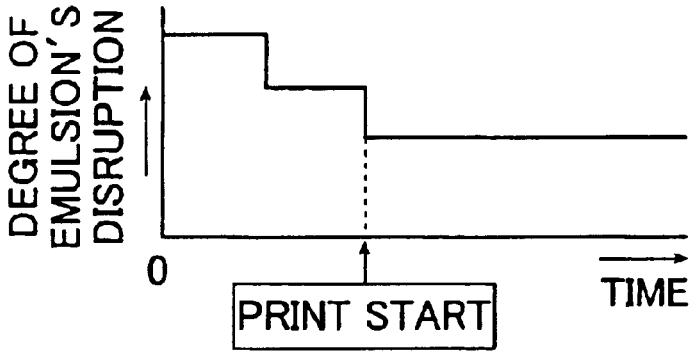
FIGS. 4A–4C are graphs specifically depicting three additional profiles for changing the degree of disruption of the emulsion in the emulsion ink.
Figure 4B:
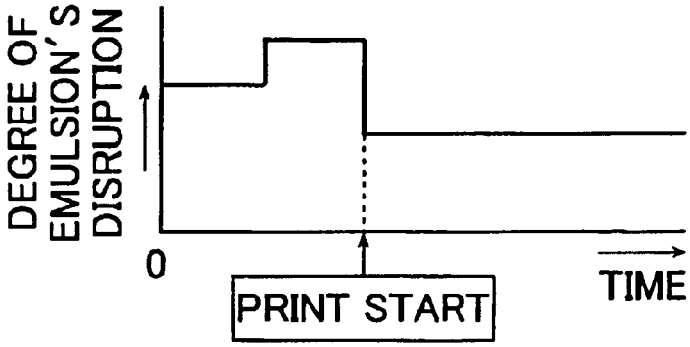
Figure 4C:
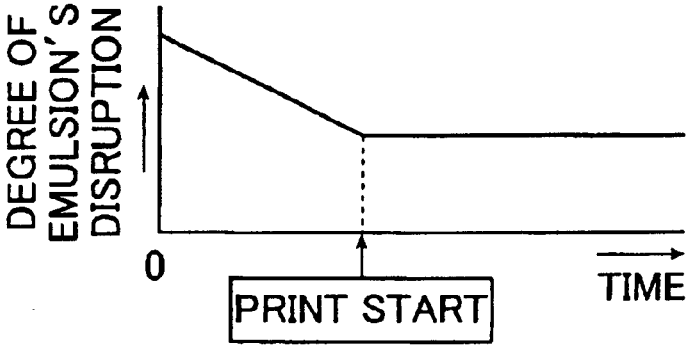
Figure 5A:
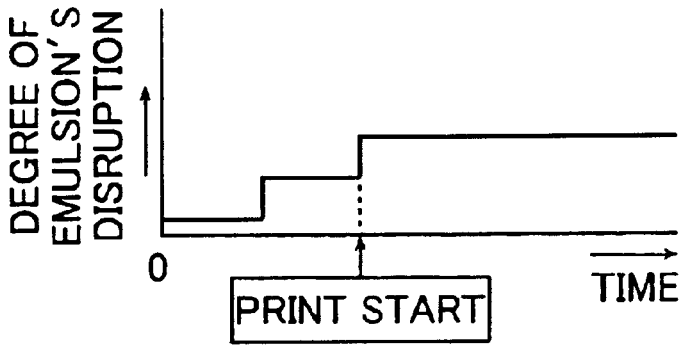
FIGS. 5A–5C are graphs specifically depicting three other profiles for changing the degree of disruption of the emulsion in the emulsion ink.
Figure 5B:
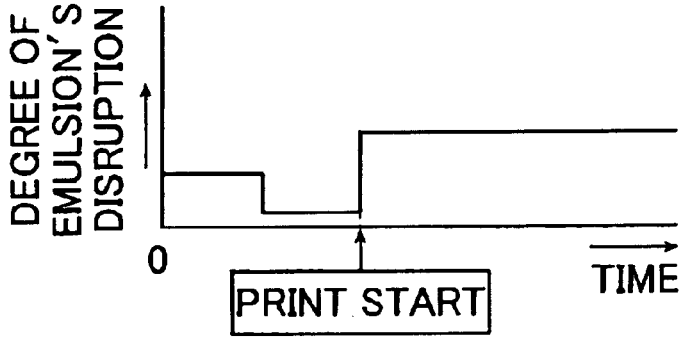
Figure 5C:
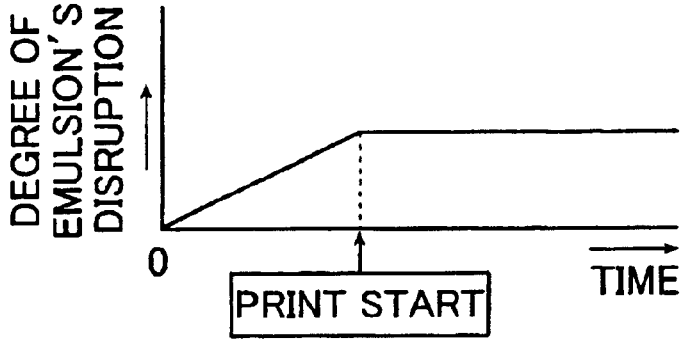

Specific profiles for performing method (a) or (b) by changing the degree of the emulsion's disruption at multiple levels or continuously are depicted in FIGS. 4A–4C and FIGS. 5A–5C. FIGS. 4A and 5A show the case of changing the degree of the emulsion's disruption at two levels before the start of printing; FIGS. 4B and 5B show the case of changing the degree of the emulsion's disruption at two levels in different ways before the start of printing; FIGS. 4C and 5C show the case of changing the degree of the emulsion's disruption continuously before the start of printing.

Figure 6:
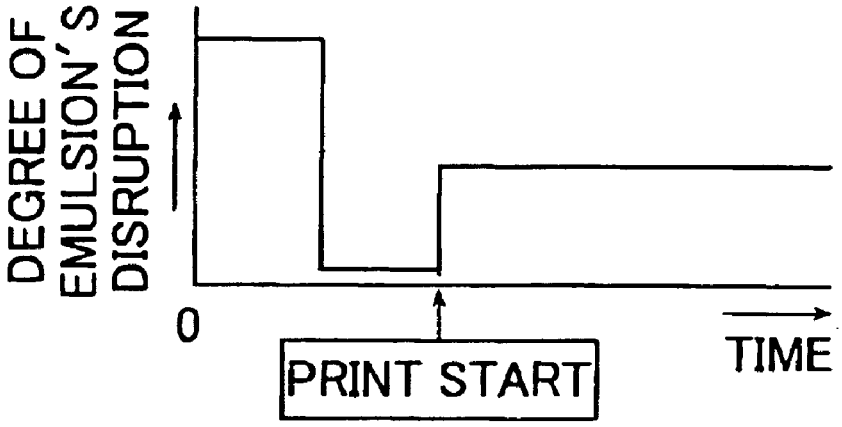
FIG. 6 is a graph specifically depicting yet another profile for changing the degree of disruption of the emulsion in the emulsion ink.
Figure 7:
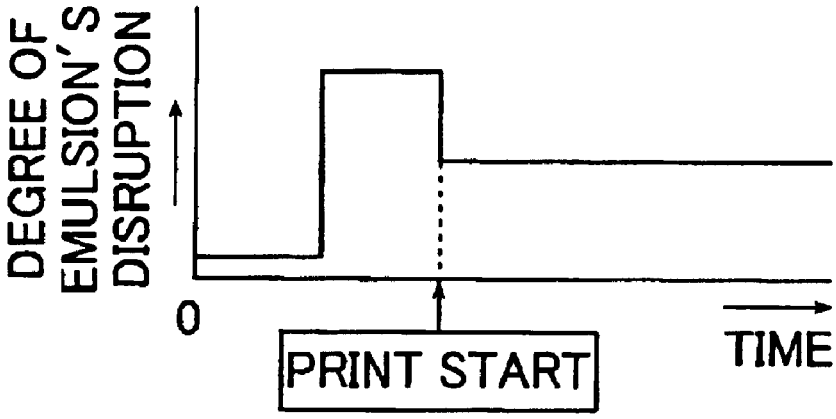
FIG. 7 is a graph specifically depicting still another profile for changing the degree of disruption of the emulsion in the emulsion ink.

Other methods that can be employed are (c) controlling the degree of the emulsion's disruption before the start of printing such that it is first greater, then smaller than the degree of the emulsion's disruption after the start of printing and (d) controlling the degree of the emulsion's disruption before the start of printing such that it is first smaller, then greater than the degree of the emulsion's disruption after the start of printing. Specific versions of methods (c) and (d) are depicted in FIGS. 6 and 7, respectively.

In methods (c) and (d), too, the degree of the emulsion's disruption can be changed at multiple levels or continuously. This is effective in not only preventing the scumming of the lithographic printing plate but also improving ink build-up.

As already mentioned, the timing of changing the degree of the emulsion's disruption may be offset from several seconds to several tens of seconds either before or after the start of printing (i.e., feeding).

In a specific example, the form roller 16 is brought into contact with the plate cylinder 22 carrying the lithographic printing plate with the emulsion having been disrupted by the emulsion disrupter 28 to a different extent than in print mode and, thereafter (for instance, after the plate cylinder 22 has made a plurality of turns), the degree of the emulsion's disruption by the emulsion disruptor 28 is changed to the degree for print mode and, thereafter (for instance, after the plate cylinder 22 has made another plurality of turns), paper is fed to start the printing operation.

As already mentioned, the present invention is characterized by controlling the degree of disruption of the emulsion in the emulsion ink such that it changes before and after the start of printing. If the ink supplying apparatus of the present invention is to be employed, the degree of the emulsion's disruption may be changed during printing depending upon changes in environmental factors such as temperature and humidity. In this case, the proportions of the ink and aqueous components may be so controlled as to achieve appropriate printing by a method such as measuring the amount of the aqueous component in the non-image areas of the printing plate.

As the printing process goes on, the degree of the emulsion's disruption may change subtly on account of various factors including the heat generated from the printing press and the change in the moisture content of the ink.

In the present invention, the change in the degree of the emulsion's disruption before and after the start of printing is preferably controlled to be greater than the above-described change in the degree of the emulsion's disruption that occurs during printing. By ensuring that a change greater than the change that occurs in the degree of the emulsion's disruption during printing is added before and after the start of printing, the advantages of the present invention will develop very effectively.

As already mentioned, the printing press 20 comprises the ink supplying apparatus 10 having the ink fountain 12, the form roller 16 and the emulsion disruptor 28, as well as the plate cylinder 22, the blanket cylinder 24 and the impression cylinder 26.

In the illustrated ink supplying apparatus 10 capable of continuous ink supply, an aggregate of emulsion ink (so-called "ink roll") may occur within the ink fountain 12. The ink roll blocks the flow of the emulsion ink within the ink fountain 12, thereby interfering with the supply of the emulsion ink. The ink roll has the additional disadvantage of changing the balance between the ink and aqueous components to cause adverse effects on printing performance.

In order to avoid these inconveniences, the ink fountain 12 has preferably an ink agitator that agitates the emulsion ink in it.

A variety of ink agitators may be employed. Two specific examples are an agitating roller rotating on a shaft parallel to the form roller 16 and a baffle plate, each being provided within a region of the ink fountain 12 where the ink roll will form. The agitating roller is preferably provided at a distance of 0–5 mm from the form roller 16. The baffle plate may take a variety of shapes including a plate, a prism and a cylinder. In order to improve the efficiency of agitation, the baffle plate may comprise a plurality of stages depending on the direction in which the form roller 16 rotates. If desired, the baffle plate may be divided into segments along the rotating axis of the form roller 16 that are in different positions in the direction of its rotation.

The plate cylinder 22, the blanket cylinder 24 and the impression cylinder 26 may each have a conventional known structure.

For the sake of simplicity in explanation, the illustrated case assumes the application of the ink supplying apparatus 10 of the present invention to the monochromatic printing press 20. The ink supplying apparatus of the present invention may adopt any known structure that enables it to be applied to a multi-color printing press capable of printing in two or more colors.

While a lithographic printing method, an ink supplying apparatus and a printing press have been described above with reference to the preferred embodiments shown in the accompanying drawings, the present invention is in no way limited to those embodiments and various modifications and improvements are possible without departing from the spirit and scope of the present invention. For example, the parts structures may be replaced by any structures that can exhibit equivalent functions.

Figure 8:
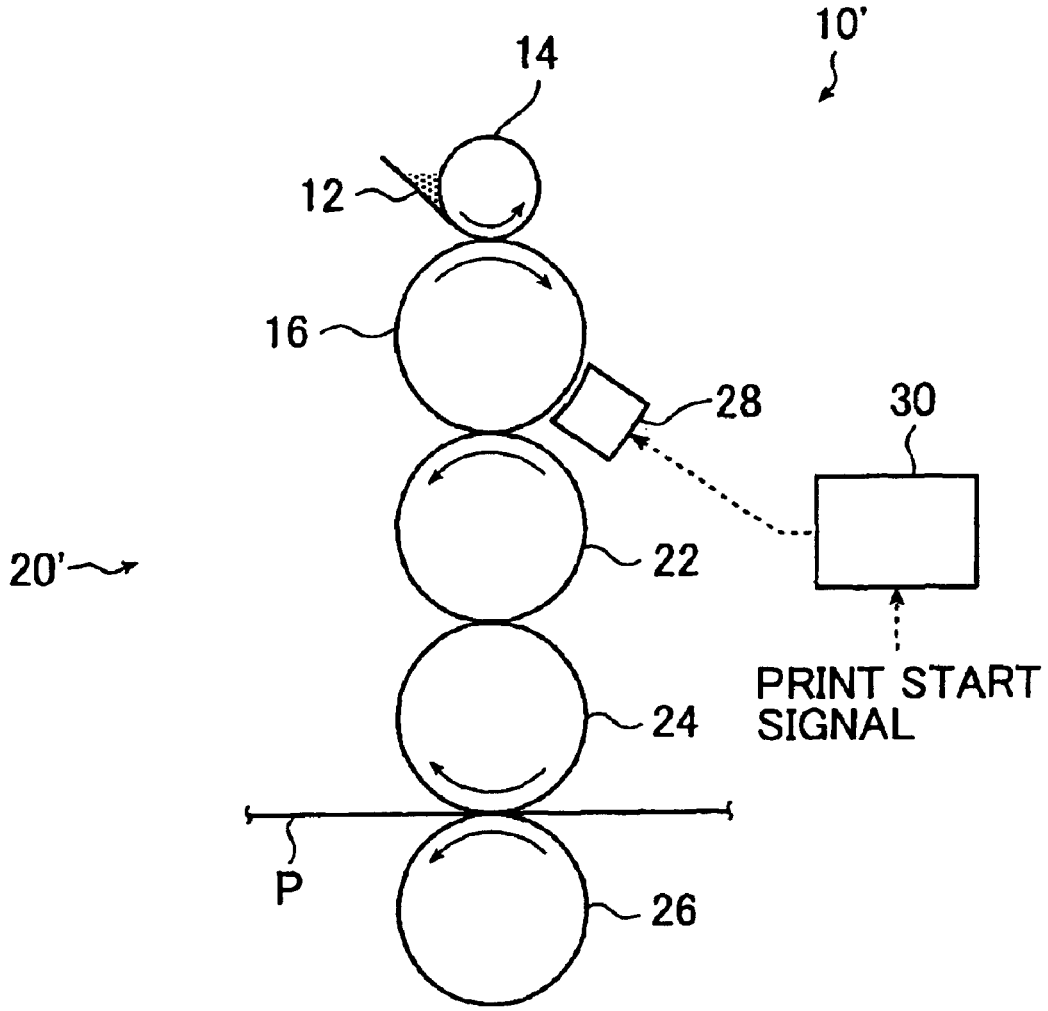
FIG. 8 shows in conceptual form another example of the printing press employing the ink supplying apparatus of the present invention.

To mention a specific example, the ink supplying apparatus 10 in FIG. 1 is so adapted that the form roller 16 draws ink out of the ink fountain 12 and this is a preferred embodiment for simplifying the apparatus. An alternative structure is shown in FIG. 8, in which an ink supplying apparatus 10' installed on a printing press 20' has an ink fountain roller 14 as an additional part that draws ink out of the ink fountain 12 and transfers it onto the form roller 16 in contact with the ink fountain roller 14. In FIG. 8, all parts that have the same constructions as those shown in FIG. 1 are identified by like numerals and need not be described in detail.

The foregoing embodiments refer to the case of wrapping the lithographic printing plate around the plate cylinder 22. This is not the sole case of the present invention and its concept may also be applied to the case of forming an image on the surface of the plate cylinder (which is generally called "plate-less printing", or a printing method in which the surface of the plate cylinder is allowed to function as a lithographic printing plate).

EXAMPLE

The following examples are provided for further illustrating the present invention but are in no way to be taken as limiting.

1. Preparing Emulsion Ink (1) Preparing Varnishes

The materials listed below were mixed under agitation to prepare three kinds of varnish, varnish A, gel varnish B and varnish C.

| | |
|---|---|
| <Varnish A> | |
| Maleated petroleum resin (NEOPOLYMER 120, product of Nippon Oil Corporation) | 47 parts by weight |
| Spindle oil | 53 parts by weight |
| <Gel varnish B> | |
| Rosin modified phenolic resin (TAMANOL 354, product of Arakawa Chemical Industries, Ltd.) | 34 parts by weight |
| Machine oil | 31 parts by weight |
| Spindle oil | 31 parts by weight |
| Aluminum stearate | 4 parts by weight |
| <Varnish C> | |
| Gilsonite | 25 parts by weight |
| Machine oil | 75 parts by weight |

(2) Preparing the Oily Ink Component

The following materials including the three kinds of varnish prepared in (1) were mixed under agitation to prepare the oily ink component of emulsion ink:

| | |
|---|---|
| Carbon black | 14 parts by weight |
| Calcium carbonate (HAKUENKA DD, product of Shiraishi Kogyo) | 5 parts by weight |
| Varnish A obtained above | 28 parts by weight |
| Gel varnish B obtained above | 7 parts by weight |
| Varnish C obtained above | 11 parts by weight |
| Linseed oil | 4 parts by weight |
| Machine oil | 6 parts by weight |
| Spindle oil | 24 parts by weight |
| Cyanine Blue | 1 part by weight |

(3) Preparing the Hydrophilic Component

The following materials were mixed under agitation to prepare the hydrophilic component of emulsion ink.

| | |
|---|---|
| Purified water | 10 parts by weight |
| Propylene glycol | 55 parts by weight |
| Glycerin | 34 parts by weight |
| Surfactant (polyoxyethylene alkylphenyl ether, LIPONOX NCE, product of The Lion Fat & Oil Co., Ltd.) | 1 parts by weight |

(4) Preparing the Emulsion Ink 100 parts by weight of the oily ink component prepared in (2) and 70 parts by weight of the hydrophilic component prepared in (3) were mixed under agitation to make a W/O type emulsion ink.

2. Printing Test

Printing was performed with the printing press 20' shown in FIG. 8. In Examples 1–4 and Comparative Example 1, an emulsion disrupting roller in contact with the form roller 16 which was variable in the direction and speed of rotation was employed as the emulsion disruptor 28. In Examples 5–8 and Comparative Example 2, an emulsion disrupting roller in contact with the form roller 16 which was capable of varying the contact pressure (nip pressure) with the form roller 16 (the contact pressure (or nip pressure) can be controlled by adjusting the width of contact (or width of nip)) was employed as the emulsion disrupter 28.

An image bearing lithographic printing plate (PS plate VS, product of Fuji Photo Film Co., Ltd.) was mounted on the plate cylinder 24 and using the W/O type emulsion ink obtained above, printing was performed on coated paper as substrate P at a speed of 5000 sheets per hour.

Example 1

With a setting of +20% for the difference in peripheral speed between the emulsion disrupting roller and the form roller, the form roller was placed in contact with the plate cylinder on which the lithographic printing plate had been mounted. After the plate cylinder made five turns, paper was fed to start printing. Almost simultaneously with the start of printing, the difference in peripheral speed between the emulsion disrupting roller and the form roller was readjusted to +10%, whereupon the fifth and subsequent sheets from start of printing were obtained as clean printed matter.

The difference in peripheral speed was assumed to be positive (+) when the emulsion disrupting roller and the form roller were rotating in the same direction at the point of their contact and the peripheral speed of the form roller was taken as the reference. The same applies in the following description.

Example 2

With a setting of zero difference in peripheral speed between the emulsion disrupting roller and the form roller, the form roller was placed in contact with the plate cylinder on which the lithographic printing plate had been mounted. After the plate cylinder made five turns, paper was fed to start printing. Almost simultaneously with the start of printing, the difference in peripheral speed between the emulsion disrupting roller and the form roller was readjusted to +10%, whereupon the fifth and subsequent sheets from start of printing were obtained as printed matter with good ink build-up.

Example 3

With a setting of zero difference in peripheral speed between the emulsion disrupting roller and the form roller, the form roller was placed in contact with the plate cylinder on which the lithographic printing plate had been mounted. After the plate cylinder made five turns, the setting of the difference in peripheral speed between the emulsion disrupting roller and the form roller was readjusted to +20%. After the plate cylinder made an additional ten turns, paper was fed to start printing. Almost simultaneously with the start of printing, the difference in peripheral speed between the emulsion disrupting roller and the form roller was readjusted to +10%, whereupon the fifth and subsequent sheets from start of printing were obtained as clean printed matter with good ink build-up.

Example 4

With a setting of zero difference in peripheral speed between the emulsion disrupting roller and the form roller, the form roller was placed in contact with the plate cylinder on which the lithographic printing plate had been mounted. After the plate cylinder made five turns, the setting of the difference in peripheral speed between the emulsion disrupting roller and the form roller was readjusted to +20%. After the plate cylinder made an additional ten turns, the difference in peripheral speed between the emulsion disrupting roller and the form roller was readjusted to +10%. Thereafter, the plate cylinder was allowed to make an additional five turns and paper was fed to start printing, whereupon the third and subsequent sheets from start of printing were obtained as clean printed matter with good ink build-up.

Comparative Example 1

With a setting of +10% for the difference in peripheral speed between the emulsion disrupting roller and the form roller, the form roller was placed in contact with the plate cylinder on which the lithographic printing plate had been mounted. After the plate cylinder made five turns, paper was fed to start printing. It took the printing of 20 sheets from start of printing to produce clean printed matter with good ink build-up.

Example 5

With a setting of 10 mm for the width of nip between the emulsion disrupting roller and the form roller, the form roller was placed in contact with the plate cylinder on which the lithographic printing plate had been mounted. After the plate cylinder made five turns, paper was fed to start printing. Almost simultaneously with the start of printing, the width of nip between the emulsion disrupting roller and the form roller was readjusted to 7 mm, whereupon the seventh and subsequent sheets from start of printing were obtained as clean printed matter.

Example 6

With a setting of 3 mm for the width of nip between the emulsion disrupting roller and the form roller, the form roller was placed in contact with the plate cylinder on which the lithographic printing plate had been mounted. After the plate cylinder made five turns, paper was fed to start printing. Almost simultaneously with the start of printing, the width of nip between the emulsion disrupting roller and the form roller was readjusted to 7 mm, whereupon the seventh and subsequent sheets from start of printing were obtained as printed matter with good ink build-up.

Example 7

With a setting of 3 mm for the width of nip between the emulsion disrupting roller and the form roller, the form roller was placed in contact with the plate cylinder on which the lithographic printing plate had been mounted. After the plate cylinder made five turns, the width of nip between the emulsion disrupting roller and the form roller was readjusted to 10 mm. After the plate cylinder made an additional ten turns, paper was fed to start printing. Almost simultaneously with the start of printing, the width of nip between the emulsion disrupting roller and the form roller was readjusted to 7 mm, whereupon the seventh and subsequent sheets from start of printing were obtained as clean printed matter with good ink build-up.

Example 8

With a setting of 3 mm for the width of nip between the emulsion disrupting roller and the form roller, the form roller was placed in contact with the plate cylinder on which the lithographic printing plate had been mounted. After the plate cylinder made five turns, the width of nip between the emulsion disrupting roller and the form roller was readjusted to 10 mm. After the plate cylinder made an additional ten turns, the width of nip between the emulsion disrupting roller and the form roller was readjusted to 7 mm. Thereafter, the plate cylinder was allowed to make an additional five turns and paper was fed to start printing, whereupon the fifth and subsequent sheets from start of printing were obtained as clean printed matter with good ink build-up.

Comparative Example 2

With a setting of 7 mm for the width of nip between the emulsion disrupting roller and the form roller, the form roller was placed in contact with the plate cylinder on which the lithographic printing plate had been mounted. After the plate cylinder made five turns, paper was fed to start printing. It took the printing of 20 sheets from start of printing to produce clean printed matter with good ink build-up.

This application claims priority on Japanese patent application No.2002-221560, the contents of which are hereby incorporated by reference. In addition, the contents of literatures cited herein are incorporated by reference.

What is claimed is:

1. A lithographic printing method of performing lithographic printing by supplying emulsion ink to a lithographic printing plate via a form roller, comprising the steps of:

supplying the emulsion ink to the form roller; and disrupting emulsion on the form roller, with a degree of the emulsion's disruption after a start of printing being different from that before the start of printing.

2. The method according to claim 1, wherein the degree of the emulsion's disruption is changed such that the degree after the start of printing is smaller than that before the start of printing.

3. The method according to claim 1, wherein the degree of the emulsion's disruption is changed such that the degree after the start of printing is greater than that before the start of printing.

4. The method according to claim 1, wherein the degree of the emulsion's disruption is changed within 30 seconds before the start of printing.

5. The method according to claim 1, wherein the degree of the emulsion's disruption is changed within 10 seconds after the start of printing.

6. An ink supplying apparatus for supplying emulsion ink to a lithographic printing plate via a form roller, comprising the form roller from which emulsion ink is supplied, an emulsion disruptor for disrupting emulsion in the emulsion ink on the form roller, and an emulsion disruption controller by which a degree of disruption of the emulsion by the emulsion disrupter after a start of printing is differentiated from that before the start of printing.

7. The ink supplying apparatus according to claim 6, wherein the emulsion disruption controller changes the degree of the emulsion's disruption to be smaller after the start of printing than the degree of the emulsion's disruption before the start of printing.

8. The ink supplying apparatus according to claim 6, wherein the emulsion disruption controller changes the degree of the emulsion's disruption to be greater after the start of printing than the degree of the emulsion's disruption before the start of printing.

9. The ink supplying apparatus according to claim 6, further comprising an ink fountain with an ink agitator.

10. The ink supplying apparatus according to claim 9, wherein the ink agitator comprises an agitating roller rotating on a shaft parallel to the form roller.

11. The ink supplying apparatus according to claim 9, wherein the ink agitator comprises a baffle plate disposed adjacent to the form roller.

12. The ink supplying apparatus according to claim 6, wherein the emulsion disruption controller receives a signal from a feeder coupled to the ink supplying apparatus.

13. A printing press comprising the ink supplying apparatus according to claim 6.

* * * * *